United States Patent [19]

Sondermann

[11] 4,298,776

[45] Nov. 3, 1981

[54] MOTOR VEHICLE IGNITION-STARTER SWITCH

[76] Inventor: Siegfried Sondermann, Honsel 290, 5880 Lüdenscheid, Fed. Rep. of Germany

[21] Appl. No.: 43,477

[22] Filed: May 29, 1979

[30] Foreign Application Priority Data

Jun. 3, 1978 [DE] Fed. Rep. of Germany ..... 2824464

[51] Int. Cl.[3] ..... H01H 9/00; H01H 21/18

[52] U.S. Cl. ..... 200/11 C; 200/4; 200/44

[58] Field of Search ..... 200/11C, 42 A, 44, 4

[56] References Cited

U.S. PATENT DOCUMENTS

| | | | |
|---|---|---|---|
| 2,502,952 | 4/1950 | Jacobi | 200/4 |
| 2,604,554 | 7/1952 | Jacobi | 200/4 |
| 3,539,737 | 11/1970 | Schupp | 200/11 C |
| 3,621,159 | 11/1971 | Heap | 200/44 X |
| 3,683,133 | 8/1972 | Heap | 200/44 |
| 3,723,678 | 3/1973 | Heap | 200/44 X |
| 3,974,348 | 8/1976 | Lipschutz | 200/11 C X |

*Primary Examiner*—James R. Scott
*Attorney, Agent, or Firm*—Bacon & Thomas

[57] ABSTRACT

The invention relates to a motor vehicle ignition-starter switch which is provided for the switching of a plurality of galvanically separated electric circuits. The switch wheel comprises lifting contact bridges, sliding contact bridges and a radially actuable slide with contact bridge. This slide cooperates simultaneously with the ignition repetitive catch.

9 Claims, 13 Drawing Figures

MOTOR VEHICLE IGNITION-STARTER SWITCH

The invention relates to a motor vehicle ignition-starter switch, the base part of which comprises a central contact and a plurality of edge contacts and the switch wheel which with the switching axle connected to the middle contact, comprises a first connecting bridge, permanently abutting the middle contact, making contact with border contacts and guided by a switching arm movable on a switching profile. A bridging element abutting, contact fingers through a double-contact head, a contact overlying the first connecting bridge and below a current-carrying contact finger. A further connecting bridge, making contact by a take-off contact on the second overlying member of the double-contact head, guided by a switching arm on a further switching profile and sliding by contact legs over the edge contacts; the connecting bridge and the bridging element are pretensioned by tension springs against the base part, and, finally, a springably pretensioned starting repetitive retaining element, guided through profile curves of the housing, and cooperating with catch profile curves.

Such a switch is known from German Patent Publication No. 25 55 110. This switch has three switch bridges which are switchable independently of one another. Thereby it is possible to switch a plurality of electric circuits independently of one another; however, these electric circuits all connect to a common middle contact.

There is the demand to switch, by means of the ignition-starter switch, still further electric circuits, e.g., the parking light electric circuit, a lamp failure control circuit, or the like, it being intended that these electric circuits be completely independent of the middle contact.

The object of the invention is to provide a motor vehicle ignition starter switch that also controls additional electric circuits and is able to switch same, and wherein the axial overall height is no greater than that shown in the German Patent Publication No. 25 55 110. Consequently, it is intended to provide still additional electric currents in the given switch inner space.

In accordance with the invention, this object is achieved by a double-contact head of a bridging element and the contact covers of switching bridges, cooperating therewith, are pushed out of the switch wheel axle, and that a tension spring of the bridging element also makes available the contact pressure for the first switching bridge.

By this configuration much space is saved for the switching bridges and particularly for the support of the switching bridges. Due to the fact that the lifting contacts and double contacts are moved out of the switching axle, it is possible to reduce the required space in the direction of the switching axle so that space is available in the switch wheel upper part for additional switching circuits.

The switching path of the switching arm of the further switching bridge may be kept smaller, because the lifting contact is moved closer to the end of the switching arm so that the motion of the switching arm is transferred to the contact head be a larger leverage. Also a reduction of the size of the switching chamber in the axial direction of the switch wheel is achieved.

It is rendered possible by the invention that there are arranged at ring wall portions of the switch wheel two ring segment contact bridges, cooperating in each case with a contact spring pair, guided in the circumferential wall of the housing. Thereby it is possible to switch the parking light electric circuits independently of the central middle contact.

In addition, the invention provides that an ignition repetitive retaining element is provided in a manner known per se as a pivotally supported catch about an axle arranged in parallel with the switch wheel axle in the switch wheel upper part, and that a slide, slidably guided in the switch wheel upper part perpendicular to the axis of the catch and pretensioned against the catch axle comprises on the one side on the front side, directed to the catch axle, the catch profile curve, also used as switch profile curve and carries, on the other front side, a contact bridge which cooperates with a contact spring pair, guided in the circumferential wall of the housing, of a lamp failure control circuit. According to the invention, the catch is utilized for the ignition repetitive interlock means as well as for the displacement of the slide and, thus, for the switching of a further electric circuit, which, e.g., may be a lamp failure control circuit. By this configuration of this additional electric circuit a space-saving structure in the upper portion of the switch wheel is achieved.

The invention renders it possible to arrange, within a limited axial space, a plurality of electric circuits and switches completely independent of one another.

BRIEF DESCRIPTION OF THE DRAWINGS

One embodiment of the invention is described in the following with reference to the attached drawings, wherein.

DESCRIPTION OF THE PREFERRED EMBODIMENT

Figure 1:
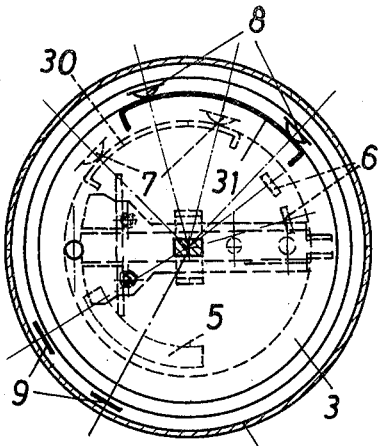
FIG. 1 shows the switch as a top view with cut-off housing cover and partially schematic representation of the contacts on the base plate.

The switch has a base part 1, a housing 2, a switch wheel 3 as well as numerous contacts and contact bridges which will be described in detail in the following. There are provided in the base part 1 a central middle contact 4 as well as a plurality of edge contacts 5, 6, which are led out through the base part 1 and immediately carry connection contacts. In addition, there are extending through the base part 1 two pairs of contact springs 7 and 8 for the parking light electric circuits and a further contact spring pair 9 for a lamp failure control electric circuit. These contact spring pairs 7, 8, 9 are completely independent electrically of the central middle contact 4 so that it is possible to switch the specific electric circuits independently of the central middle contact 4. The base part 1 defines on its periphery different profile curves or cams, not shown in detail, which serve for the shifting of contact bridges, as will be explained in detail in the following.

The housing 2 is bowllike and comprises a covering wall 10, a circumferential wall 11 as well as a central bearing part 12. The housing 2 is connected by clip connections, which are not shown in detail, with the base part 1. The circumferential wall 11 also serves for the holding and guiding of the contact spring pairs 8 and 9. In the range of the circumferential wall 11 in the proximity of the covering wall 10 there are provided an ignition repetitive retaining cam 13 and a reset profile or cam 14. Furthermore, the covering wall 10 defines a profile curve or cam 15 and, in addition, locking profiles 16 for the determination of the different switching positions. In the bearing part 12 a spring 17 is received which serves for the resetting of the switch wheel from the ignition position.

Figure 5:
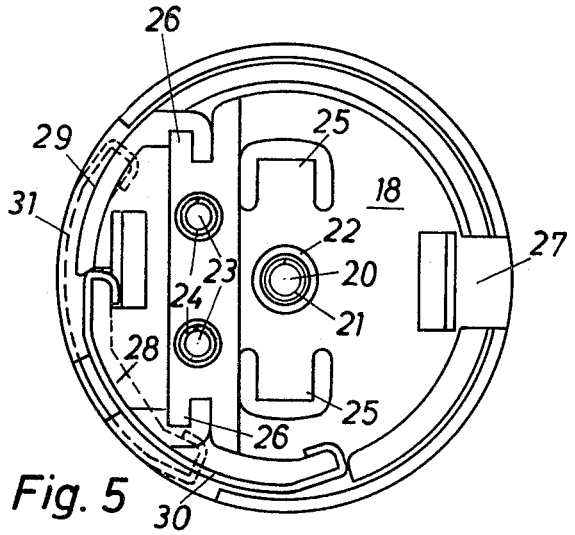

The switch wheel 3 consists of a switch wheel lower part 18 and a switch wheel upper part 19. The switch wheel lower part 18 is illustrated in FIG. 5 as seen from below. The switch wheel lower part 18 comprises a receiving chamber 20, directed in the direction of the switch wheel axis, for a compression spring 21. The receiving chamber 20 is closed by an outer ring wall 22. Furthermore, there are provided additional chambers 23 for receiving compression springs 24. The receiving chamber 20 and, thus, also the switch wheel axis are opposite to two oppositely arranged U-shaped guides 25. About in the range of the chambers 23, there are provided two further guides 26 open in regard to each other. Finally, there is provided on the periphery of the switch wheel lower part 18 a guidance recess 27.

The switch wheel lower part comprises in the axial direction and radial direction ring wall sections 28 and 29, displaced relatively to each other, on which ring segment contact bridges 30 and 31 abut and which are kept by means of bent flaps in recesses or perforations of the wall of the switch wheel lower part.

Figure 6:
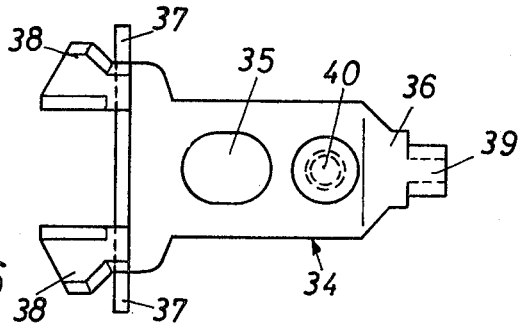
FIG. 6 is a top view of the further contact bridge.
Figure 7:
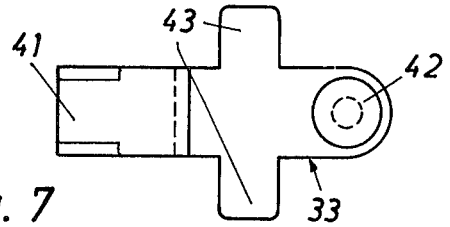
FIG. 7 shows the bridging element.
Figure 8:
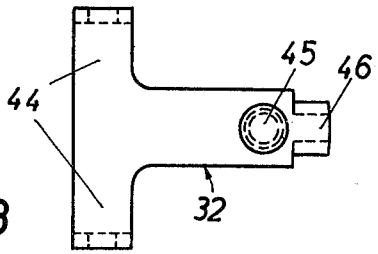
FIG. 8 shows the first contact bridge.

FIGS. 6 to 8 show a first switching bridge 32, a bridging element 33 as well as a further switching bridge 34 which are received in the switch wheel lower part 18. The further switching bridge 34 is against the bottom of the interior of the switch wheel lower part 18. The further switching bridge 34 comprises a guidance passage 35 which extends around the ring wall 22. A projection 36 is guided in the guidance recess 27. The further switching bridge 34 is situated in the guidances 26 by legs 37. The compression springs 24 provide the contact pressure for this further switching bridge. The contact legs 38 cooperate with edge contacts 6. A switching arm 39 glides on, but not shown, profile curves of the base part 1. This further switching bridge 34 comprises also a lifting contact 40.

The bridging element 33 has, on one side, a contact finger 41 and, on the other side, a double contact head 42. Two guidance legs 43 are situated in the guidances 25 of the switch wheel lower part and, thus, guide the bridging element 33. The compression spring 21 provides the contact pressure for this bridging element and also for the first switching bridge 32 which also comprises two guidance legs 44 and, in addition, a lifting contact 45 which cooperates with the edge contact 5. A switching arm 46 of this first switching bridge 32 cooperates with a profile curve of the base part 1.

Figure 2:
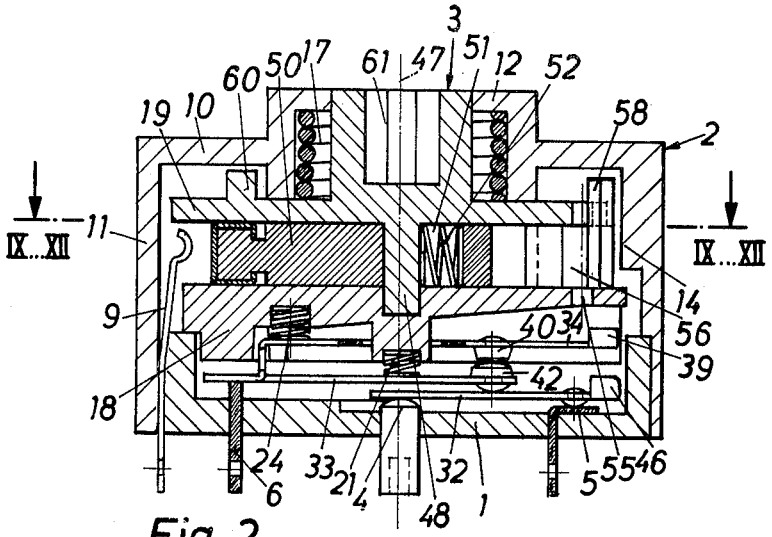
FIG. 2 is an axial section through the switch according to FIG. 1, numerous contact parts being turned into the plane of projection.

With reference to FIG. 5 after the insertion of the compression springs 21 and 24 into the chambers 20 and 23, firstly, the further switching bridge 34, then the bridging element 33 and, ultimately, the first switching bridge 32 are inserted into the switch wheel lower part 18. FIG. 2 shows the condition of assembly of the different switching bridges in section. It is evident that the compression spring 21 delivers not only the contact pressure for the bridging element 33, but also for the first switching bridge 32. This double function of the compression spring 21 is possible because the double contact head 42 is arranged outside the switch wheel axis 47. The compression spring 21 is positioned on the switch wheel axis. Thereby a symmetrical application of the contact pressure and the saving of a particular spring for the first switching bridge 32 results. The further switching bridge 34 requires, in the range of the lifting contact 40, merely a comparatively small switching way so that thereby it is possible to keep the switching chamber comparatively small in the axial direction.

Figure 4:
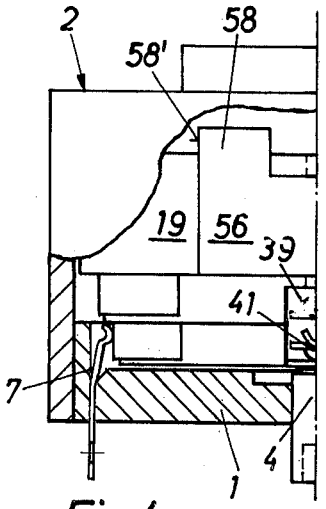
FIG. 4 shows a broken away half view with the switch wheel in the view, FIG. 5 a bottom view of the switch wheel.

The switch wheel upper part 19 is connected with the switch wheel lower part 18, e.g. by cog connections, or in another manner. A cog 48 is illustrated in the Figures. The switch wheel upper part, which is illustrated in FIGS. 9 to 12, comprises a radial recess 49, a slide 50 being guided therein. A recess 51 of the slide 50 overlaps the cog 48, where a compression spring 52 rests on, which abuts a wall of the recess 51 and thereby pretensions the slide 50. At one front end the slide 50 comprises a triangle profile 53. At the other front end the slide carries a contact bridge 54, cooperating with the contact spring pair 9. The switch wheel upper part 19 receives, on a pivot pin 55, a catch 56, which comprises, on the one side, a triangle cam 57, which cooperates with the triangle profile 53, and on the other side, a guide shoe 58 having a stop edge 58′ which (guide shoe) projects over the switch wheel upper part 19 upwards against the cover wall 10 of the housing 2, cf. particularly FIGS. 2 and 4, and abuts the wall portion 62 (FIG. 9) the waiting position.

Figure 13:
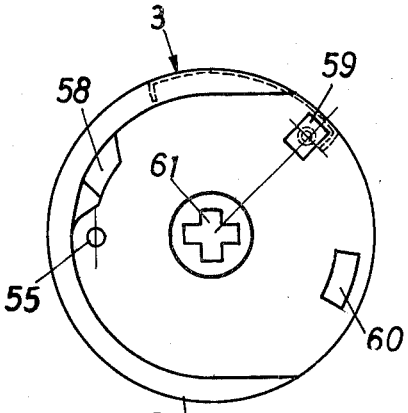
FIG. 13 shows a top view of the switch wheel upper part.
Figure 3:
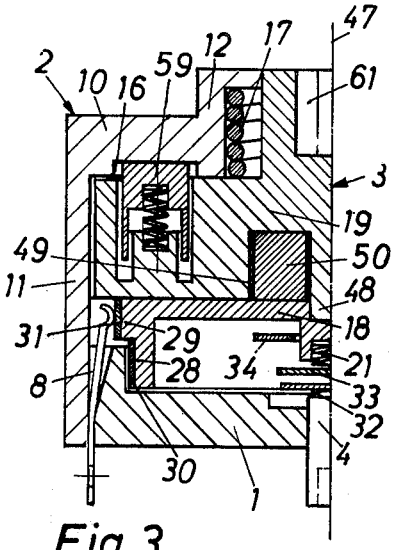
FIG. 3 shows an axial half section with the switch wheel in an alignment turned by 90° as compared with FIG. 2.

The switch wheel upper part receives, in accordance with FIG. 3 and FIG. 13, a springtensioned catch element 59, cooperating with the catch profile 16 in the cover wall 10 and thereby fixing the switching positions of the switch. Furthermore, there is shaped on the top wall of the switch wheel upper part 19 a catch pin 60, upon which a leg of the spiral spring 17 is positioned and thereby acts upon the switch wheel in the sense of a resetting from the ignition position. The switch wheel upper part 19 possesses in its dome a cam profile 61 for the lock cylinder pin of the steering lock. By this lock cylinder pin the switch wheel is operated in a manner known per se.

FIG. 1 shows the switch wheel in the cut-off position. In this cut-off position, particularly by the ring segment contact bridges 30 and 31, the contact spring pairs 7 and 8 are bridged so that the parking light electric currents are operative and can be switched accordingly by the driving direction switch or another switch. In this cut-off position, it is also possible to switch further electric circuits, e.g., an electric circuit for radio or other consumers, for which it is necessary to supply them with electric current in the state of rest.

Figure 9:
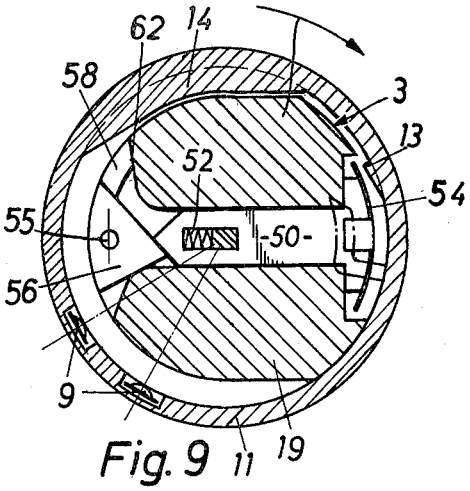
FIG. 9 is a radial section through the switch at the height of the switch wheel upper part in the switch-off position.
Figure 10:
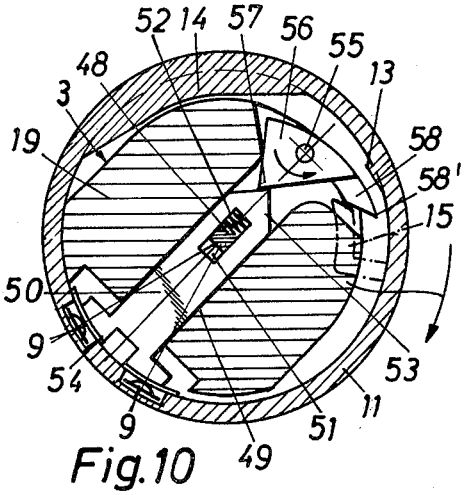
FIG. 10 is a view corresponding to FIG. 9 with the switch in the lamp failure control position.
Figure 12:
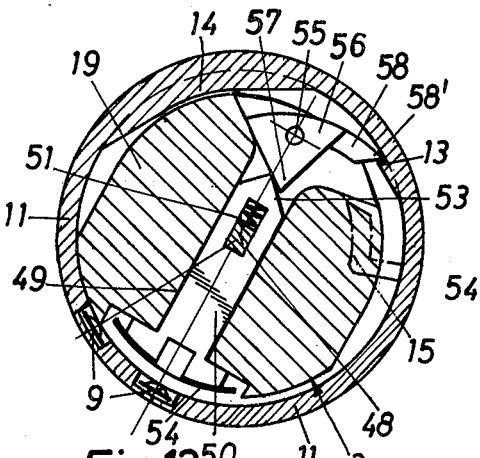
FIG. 12 is a view corresponding to FIG. 9 with the switch conditioned for moving and with the catch in the blocking position.

This cut-off position is again illustrated in FIG. 9, related to the switch wheel upper part. The slide 50 is in the position as shown in FIG. 9; the catch 56 is kept by the action of the compression spring 52 in the stable position according to FIG. 9, in which the guide shoe 58 abuts the wall portion 62 of the switch wheel upper part. When operating the ignition lock for the starting of the motor vehicle the switch wheel upper part, related to FIG. 9, is turned in clockwise direction and the lamp failure control position as shown in FIG. 10 is reached. In this position the guide shoe 58 pushes on the profile curve 15 in the cover wall 10 of the housing 2 so that the catch 56 is swung around the pin 55 counterclockwise. The triangle cam 57 acts upon the triangle profile 53 so that the slide 50 is displaced against the action of the compression spring 52 and the contact bridge 54 is moved radially outwards. In this position the contact bridge 54 abuts the contact spring pair 9 so that the lamp failure control circuit is closed.

Figure 11:
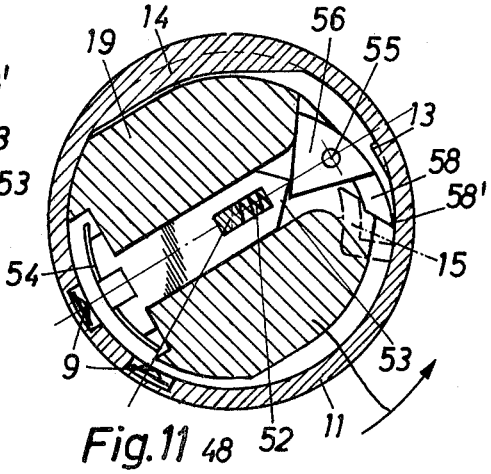
FIG. 11 is a view corresponding to FIG. 9 with the switch in the ignition position.

When further turning the switch wheel into the starting position shown in FIG. 11, the catch 56 is further swivelled counterclockwise by the profile curve 15, until the triangle cam 57 slides over the apex of the triangle profile 53. Under the action of the compression spring 52 the catch 56 is pretensioned counterclockwise and the guide shoe 58 is kept in abutment with the circumferential wall 11 of the housing 2. As soon as the motor is started, the ignition key is released, so that the switch wheel turns back under the action of the leg spring 17 into the ignition position shown in FIG. 12. In this ignition position, the guide shoe 58 snaps in behind the ignition repetitive catching cam 13 and an immediate rotation of the switch wheel into the starting position is impossible. If the switch wheel is turned back into the cut-off position, the guide shoe 58 pushes on the resetting profile 14 so that thereby the catch 56 is swung clockwise. The triangle cam 57 is moved over the tip of the triangle profile 53 and is brought into the original position shown in FIG. 9.

The catch 56 is utilized, in accordance with the invention, for the ignition repetitive catch as well as for the switching of the slide 50 for the lamp failure control circuit. By this it is possible to utilize the constructional elements several times so that on the whole a saving of constructional elements is possible; that is extremely important for such a comparatively small-space switch.

I claim:

1. In a motor vehicle ignition-starter switch having a housing including a base part provided with a middle contact and a plurality of border contacts, a switch wheel having a first switching bridge permanently abutting the middle contact and arranged to be rotated into contact with border contacts on said base part, a bridging element having a double-contact head in contact with a contact of said first switching bridge and arranged to be rotated into contact with further border contacts, a further switching bridge, making contact through a take-off contact on said double-contact head and arranged to slidably engage said border contacts; the connecting bridges and the bridging element being pretensioned by springs toward the base part, and a springably pretensioned starting repetitive retaining element the improvement comprising: two ring segment contact bridges of the switch wheel on ring wall portions thereof, which cooperate with two contact spring pairs and being guided in a circumferential wall of the housing and an ignition repetitive retaining element in the form of a catch, pivotally supported on said switch wheel about an axis parallel to the switch wheel axis and a catching profile being arranged on a slide guided for radial sliding on said wheel toward said catch, a switch part extending perpendicular to the axis of the catch pivot and pretensioned towards the catch axis, said slide having a contact bridge thereon which cooperates with a further contact spring pair in the circumferential wall of the housing.

2. A motor vehicle ignition-starter switch according to claim 1, wherein the switch wheel has a receiving chamber, aligned in the direction of the switch wheel axis and housing a spring for the bridging element.

3. A motor vehicle ignition-starter switch according to claim 2, wherein the receiving chamber has a ring wall around which a guidance slot of the further switching bridge extends.

4. A motor vehicle ignition-starter switch according to claim 1, wherein the two ring segment contact bridges are provided on said switch wheel and are relatively displaceable in a radial direction.

5. A motor vehicle ignition-starter switch according to claim 4, wherein the two ring segment contact bridges are displaceable relatively to one another also in the circumferential direction, and wherein the cooperating contact spring pairs extend from the base part and abut the circumferential wall of the housing.

6. A motor vehicle ignition-starter switch according to claim 1, wherein the catching profile curve is provided as a triangle profile and wherein the catch comprises a triangle cam, cooperating with the triangle profile.

7. A motor vehicle ignition-switch according to claim 1, wherein the catch is between a switch wheel upper part and a switch wheel lower part, and wherein a guidance shoe on the catch extends through a cutout of the switch wheel upper part, the guidance shoe working together with profile curves on the housing.

8. A motor vehicle ignition-starter switch according to claim 7, wherein the guidance shoe comprises a locking edge which cooperates with an ignition repetitive locking cam on the housing.

9. A motor vehicle ignition-starter switch according to claim 7, wherein a circumferential wall of the housing defines a resetting profile upon which the guidance shoe engages when the switch wheel is rotated in one direction, and thereby switches over the catch automatically into its original position.

* * * * *